United States Patent [19]

Deal et al.

[11] Patent Number: 4,884,004

[45] Date of Patent: Nov. 28, 1989

[54] COLOR CATHODE-RAY TUBE HAVING A HEAT DISSIPATIVE, ELECTRON REFLECTIVE COATING ON A COLOR SELECTION ELECTRODE

[75] Inventors: Samuel B. Deal, Lancaster; Donald W. Bartch, Wrightsville, both of Pa.

[73] Assignee: RCA Licensing Corp., Princeton, N.J.

[21] Appl. No.: 238,378

[22] Filed: Aug. 31, 1988

[51] Int. Cl.[4] ..... H01J 29/07; H01J 9/02

[52] U.S. Cl. ..... 313/402; 445/37; 445/58

[58] Field of Search ..... 313/402, 407, 408; 445/30, 37, 47, 58

[56] References Cited

U.S. PATENT DOCUMENTS

| | | | |
|---|---|---|---|
| 3,562,518 | 2/1971 | Javorik et al. | 313/85 |
| 3,878,428 | 4/1975 | Kuzminski et al. | 313/408 |
| 4,128,790 | 12/1978 | Steeghs | 315/382 |
| 4,222,159 | 9/1980 | Koorneef | 29/25.14 |
| 4,339,687 | 7/1982 | Redington | 313/402 |
| 4,442,376 | 4/1984 | Van Der Waal et al. | 313/402 |
| 4,620,133 | 10/1986 | Morrell et al. | 315/15 |
| 4,629,932 | 12/1986 | Tokita | 313/402 |
| 4,671,776 | 6/1987 | Tokita | 445/51 |

FOREIGN PATENT DOCUMENTS

| | | |
|---|---|---|
| 2487117 | 1/1982 | France . |
| 55-76553 | 9/1980 | Japan . |

*Primary Examiner*—Donald J. Yusko
*Assistant Examiner*—Sandra L. O'Shea
*Attorney, Agent, or Firm*—Joseph S. Tripoli; Dennis H. Irlbeck; Vincent J. Coughlin, Jr.

[57] ABSTRACT

A color cathode-ray tube comprises an evacuated envelope having an electron gun for producing at least one electron beam and, preferably three beams, a phosphor screen and a shadow mask adjacent to the screen. The mask has an improved heat dissipative, electron reflective coating on its electron gun-facing surface to minimize the effects of overall mask doming and blister warpage. The coating comprises a compound selected from the group consisting of bismuth (tri)oxide-potassium silicate and tungsten-potassium silicate. A method of making and applying the coating also is disclosed.

5 Claims, 1 Drawing Sheet

COLOR CATHODE-RAY TUBE HAVING A HEAT DISSIPATIVE, ELECTRON REFLECTIVE COATING ON A COLOR SELECTION ELECTRODE

BACKGROUND OF THE INVENTION

This invention relates to a color cathode ray tube having an evacuated envelope with means for producing at least one electron beam, a cathodoluminescent screen and a color selection electrode adjacent to the screen with a heat dissipative and electron reflective coating on a surface of the color selection electrode. The novel coating is capable of minimizing local heating of the color selection electrode, especially in high brightness portions of the display, by backscattering a large number of the incident electrons which would otherwise cause local expansion of the color selection electrode and generate color errors. The coating also has a surface which provides effective radiative heat transfer.

During operation of the color cathode-ray tube having a color selection electrode, or shadow mask, only a small fraction of each electron beam is passed through the apertures in the shadow mask. At about the center of the mask, the masking plate intercepts all but about 18% of the beam; that is, the shadow mask is said to have a transmission of about 18%. The electrons comprising the remaining 82% of the electron beam are intercepted by the mask plate on their way to the screen. The kinetic energy of the impinging electrons is converted into thermal energy with an increase in shadow mask temperatures resulting in thermal expansion of the mask. Since the mask is usually supported by a frame of substantial mass, the temperature of the shadow mask during initial warm-up will rise more rapidly in the center than at the edge. This causes the mask to dome, so that the center portion of the mask moves toward the screen, while the edge of the mask maintains its spacing with the screen. Furthermore, when a large number of electrons impinge on a local area of the mask, to create high picture brightness, localized doming or blister warpage occurs unless temperature equilibrium in the plane of the shadow mask is reestablished sufficiently rapidly. Both blister warpage and overall doming of the shadow mask result in color errors due to electron beam misregister with the phosphor elements of the screen.

U.S. Pat. No. 3,878,428, issued to Kuziminski et al. on Apr. 15, 1975, discloses a CRT having a tailored heat transfer pattern formed, at least, on facing center surfaces of the screen and shadow mask. The hotter mask radiates heat to and through the lower temperature envelope. An absorptive black coating is formed on the center surfaces and a reflective layer is generally provided on at least a portion of the peripheries of the surfaces.

Such a coating structure addresses the problem of overall mask doming; however, the coating is ineffective for counteracting the color errors resulting from intense, localized electron impingement, which causes blister warpage, because the radiative heat transfer mechanism provided by the coating cannot rapidly reestablish thermal equilibrium.

U.S. Pat. No. 4,339,687, issued to Redington on July 13, 1982, discloses a layer of high atomic number material such as tungsten or gold deposited e.g., by vacuum evaporation, sputtering, vapor deposition, etc., on the electron gun-facing surface of the shadow mask to increase the percentage of electrons backscattered from the mask. This is disclosed to be effective for reducing the effects of localized doming or blister warpage.

Gold, of course, is economically impractical and the disclosed techniques for depositing tungsten are not cost effective or practical for large size tubes.

U.S. Pat. No. 4,442,376, issued to Van Der Waal et al. on Apr. 10, 1984, discloses a heavy metal having an atomic number exceeding 70 with a high electron reflection coefficient to minimize energy absorption by the shadow mask. Suitable materials, which are economical, include the heavy metals tungsten, lead and bismuth and their compounds selected from the group consisting of carbides, sulphides and oxides.

However, it is known to those skilled in the art that the use of sulfides within the tube envelope is generally avoided since sulfides have a detrimental effect on cathode emission. Carbides are difficult to deposit and thus add to the cost of tube manufacturing. Likewise, oxides form generally thin layers, and considerable time, and therefore additional cost, is required to provide an oxide layer of suitable thickness.

A need therefore exists for a shadow mask coating that addresses the problems of both overall doming and blister warpage, and that is inexpensive and practical to apply.

SUMMARY OF THE INVENTION

A cathode ray tube comprises an evacuated envelope having therein means for producing at least one electron beam, a phosphor screen and a color selection electrode adjacent to the screen. The color selection electrode has an improved heat dissipative and electron reflective coating on the surface facing the electron beam producing means. The coating comprises a compound selected from the group consisting of bismuth oxide-potassium silicate and tungsten-potassium silicate. A method of making and applying the coating also is disclosed. The novel coating is more cost effective than prior coatings since it can be applied by spraying.

DETAILED DESCRIPTION OF THE PREFERRED EMBODIMENTS

Figure 1:
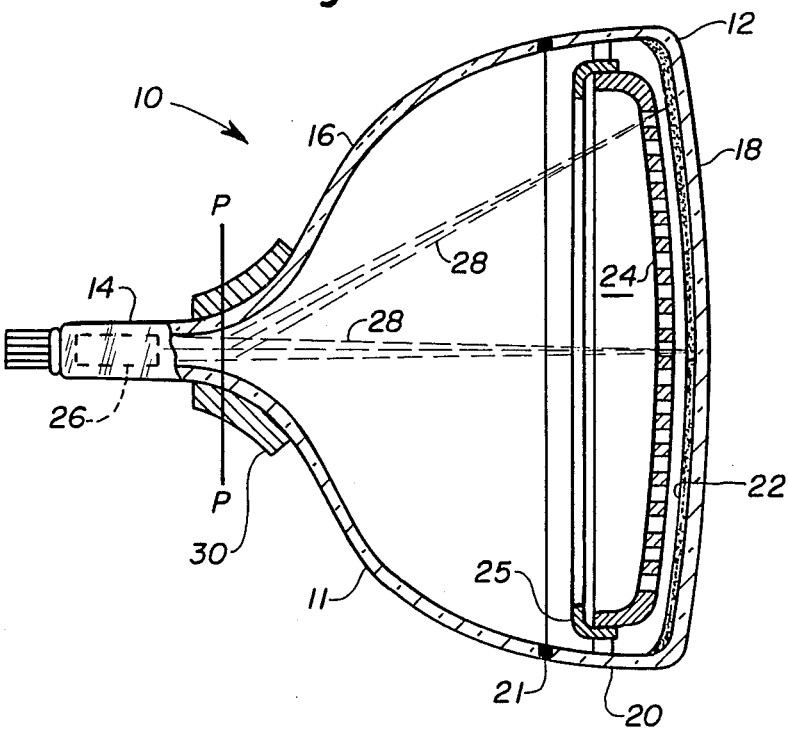
FIG. 1 is a plan view, partially in axial section, of a cathode-ray tube, CRT, embodying the present invention.

FIG. 1 shows a rectangular color cathode-ray tube 10, e.g., a color television picture tube or a display tube, having an evacuated glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 by a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 having an attached frame 25 is removeably mounted, by conventional means, in predetermined spaced relation to the screen 22. An electron gun 26, shown schematically by dashed lines in FIG. 1, is centrally mounted within the neck 14 to generate and direct at least one electron beam, and preferably three beams 28, through the mask 24 and toward the screen 22. One type of electron gun that is conventional is an inline bi-potential electron gun having four grids such as that described in U.S. Pat. No. 4,620,133 issued to Morrell et al. on Oct. 28, 1986 which is incorporated by reference herein for the purpose of disclosure.

The tube of FIG. 1 is designed to be used with an external magnetic deflection yoke, such as yoke 30 located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1, at about the middle of the yoke 10.

Figure 2:
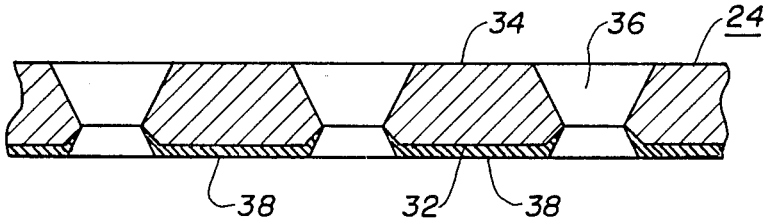
FIG. 2 is a sectional view of a part of a color selection electrode of the CRT shown in FIG. 1.

As shown in FIG. 2, the shadow mask 24 has an obverse or O-side 32 facing the electron gun 26, a reverse or R-side 34 facing the screen 22 and a plurality of apertures 36 formed therethrough. A novel heat dissipative and electron reflective coating 38 covers the O-side 32 of the mask 24. The coating comprises a O-side 32 of the mask 24. The coating comprises a compound selected from the group consisting of bismuth oxide-potassium silicate and tungsten-potassium silicate.

EXAMPLE 1

With the shadow mask 24 and its frame 25 removed from the faceplate panel 12, the frame 25 is masked to prevent the deposit of the coating 38 thereon. The mask and frame are mounted in a fixture (not shown) in a spray booth (also not shown) having exhaust means. The O-side 32 of the mask is directed towards a spray gun (not shown). A bismuth (tri)oxide-potassium silicate coating composition is prepared by mixing 16.84 parts by weight (pbw.) of bismuth oxide ($Bi_2O_3$) marketed by J. T. Baker, Inc., Phillipsburg, NJ, 3.16 pbw. potassium silicate (KASIL 88) marketed by PQ Corporation, Valley Forge, PA, 0.2 pbw. dispersant (MARASPERSE CBOS-3 marketed by Reed Lignin Co., Rothschild, WI, and 79.8 pbw. deionized water.

The composition, which has a 6:1 mole ratio of $Bi_2O_3$:$K_2O.SiO_2$, is milled in a ball mill, or the equivalent, for 6 hours and then loaded into a spray container (not shown) which can continuously stir and recirculate the composition to keep the high density solids in suspension. The spray is applied in 24 frames (6-6-6-6) with six passes per frame. The fixture is rotated 90° after each set of six frames. The spray gun is adjusted for a flow rate of 50 ml. per minute and the atomizing pressure is set at 50 psi. With the spray gun mounted about 16 inches from the mask 24, the final coating thickness is about 5 microns. Tubes made using the novel bismuth (tri)oxide-potassium silicate coating exhibit a decrease in both overall doming and blister warpage.

A test conducted on a 26V110° COTY, (Combined Optimized Tube & Yoke) CRT having a shadow mask manufactured as described, showed a 23% reduction in overall doming and a 22% reduction in blister warpage over a 4.5 inch square area that was bombarded by an electron beam.

EXAMPLE 2

An alternative coating composition of tungsten-potassium silicate is prepared by mixing 16.97 pbw. tungsten powder marketed by Fisher Scientific Co., Pittsburgh, PA, 3.03 pbw. potassium silicate (KASIL 88) marketed by PQ Corporation, Valley Forge, PA, 0.2 pbw. dispersant (MARASPERSE CBOS-3) marketed by Reed Lignin Co., Rothschild, WI.

79.8 pbw. deionized water.

The composition, which has a 16:1 mole ratio of W:$K_2O.SiO_2$, is rolled and applied as described in example 1 to obtain a tungsten-potassium silicate coating having a thickness of about 5 microns. A test conducted on a 26V110° COTY CRT sample showed a 21% reduction in overall doming and a 32% reduction in blister warpage over a 4.5 inch square area.

GENERAL CONSIDERATIONS

The use of potassium silicate as a binder increases the adherence of the coating compounds. Additionally, the potassium silicate provides higher atomic weight concentrations of both bismuth oxide and tungsten than would be otherwise available by the methods of the prior art. Also, the potassium silicate-containing coating has an irregular surface contour which provides an increased surface area for getter deposition and for radiative transfer. Surprisingly, the potassium silicate binder does not tend to block the apertures in the shadow mask since the binder tends to "pull back" from the edges of the aperture after spraying and heating during subsequent tube processing.

What is claimed is:

1. In a color cathode-ray tube comprising an evacuated envelope having therein means for producing at least one electron beam, a phosphor screen and a color selection electrode disposed adjacent to said screen, said color selection electrode having a heat dissipative and electron reflective coating on a surface thereof facing said electron beam producing means, the improvement wherein said coating comprises a compound selected from the group consisting of bismuth oxide-potassium silicate and tungsten-potassium silicate.

2. The tube as described in claim 1, wherein said coating has a thickness of about 5 microns.

3. In a method of making a heat dissipative and electron reflective coating for a color selection electrode of a color cathode ray tube having an evacuated envelope with electron beam producing means therein and a phosphor screen on a portion of said envelope adjacent to said color selection electrode, said coating being on a surface of said color selection electrode facing said electron beam producing means, the method comprising the steps of (a) forming an aqueous suspension of a compound selected from the group consisting of bismuth oxide-potassium silicate and tungsten-potassium silicate, and (b) spraying a plurality of layers of said compound onto said surface of said color selection electrodes to form said coating.

4. The method as in claim 3, including the additional step, after step (b) of rotating said color selection electrode 90° and repeating step (b).

5. The method as in claim 4, wherein the sequence of steps of rotating the color selection electrode 90″ and then spraying a plurality of layers of said compound onto said surface is repeated until said color selection electrode is returned to its original position.

* * * * *

UNITED STATES PATENT AND TRADEMARK OFFICE

CERTIFICATE OF CORRECTION

PATENT NO. : 4,884,004

DATED : November 28, 1989

INVENTOR(S) : Samuel B. Deal, et al

It is certified that error appears in the above-identified patent and that said Letters Patent is hereby corrected as shown below:

Title page, Col. 1, line 2, delete "Color".

Col. 3, line 19, change "10" to --30--.

Col. 3, lines 25 and 26, delete "The coating comprises a O-side 32 of the mask 24."

Col. 4, line 64, change "90'''" to --90°--.

Signed and Sealed this

Eighteenth Day of December, 1990

*Attest:*

HARRY F. MANBECK, JR.

*Attesting Officer*

*Commissioner of Patents and Trademarks*